US012404667B2

(12) United States Patent
Yamamura et al.

(10) Patent No.: US 12,404,667 B2
(45) Date of Patent: Sep. 2, 2025

(54) SANITARY WASHING DEVICE

(71) Applicant: TOTO LTD., Kitakyushu (JP)

(72) Inventors: Saki Yamamura, Kitakyushu (JP); Shuhei Hayata, Kitakyushu (JP); Tomonori Suzuki, Kitakyushu (JP); Takakuni Yoshida, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 186 days.

(21) Appl. No.: 18/318,767

(22) Filed: May 17, 2023

(65) Prior Publication Data

US 2023/0407616 A1 Dec. 21, 2023

(30) Foreign Application Priority Data

Jun. 16, 2022 (JP) ..... 2022-097336

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/420.2, 447, 443, 420.4, 420.1
See application file for complete search history.

(56) References Cited

U.S. PATENT DOCUMENTS 4,370,764 A 2/1983 Ando et al.
6,430,366 B1 * 8/2002 Mizutani ..... E03D 9/08 392/449
7,051,381 B2 * 5/2006 Furukawa ..... E03D 5/105 4/246.1
2003/0019023 A1 1/2003 Furukawa et al.
2003/0229938 A1 * 12/2003 Hayashi ..... E03D 9/08 4/216
2003/0229983 A1 12/2003 Bourgeois
2006/0289455 A1 * 12/2006 Nakamura ..... F24H 1/102 219/494
2021/0164212 A1 6/2021 Baba et al.

FOREIGN PATENT DOCUMENTS

CN 1407189 A 4/2003
CN 210827732 U 6/2020
JP S55-81331 U 6/1980
JP S55-081331 U 6/1980
(Continued)

*Primary Examiner* — David P Angwin
*Assistant Examiner* — Christopher S. Parisi
(74) *Attorney, Agent, or Firm* — MCDONALD HOPKINS LLC

(57) ABSTRACT

A sanitary washing device includes a nozzle, a heat exchanger, a cold water flow channel, a switching element, a control board, a heat transfer plate, and a casing. The heat exchanger uses alternating current power to heat the wash water supplied to the nozzle. The cold water flow channel supplies the wash water to the heat exchanger from a water supply source. The switching element switches a supply state of the alternating current power to the heat exchanger. A controller is mounted to the control board. The controller is operated by direct current power. The controller controls the switching element. The heat transfer plate is configured to dissipate heat of the switching element. The switching element is mounted to the control board. The cold water flow channel includes a cooling part. The cooling part water-cools the heat transfer plate.

5 Claims, 10 Drawing Sheets

(56) References Cited

FOREIGN PATENT DOCUMENTS

| | | | |
|---|---|---|---|
| JP | H01-083735 | A | 3/1989 |
| JP | S64-83735 | A | 3/1989 |
| JP | 2827900 | B2 | 11/1998 |
| JP | 2003-328419 | A | 11/2003 |
| JP | 2014-190144 | A | 10/2014 |
| JP | 2017-227083 | A | 12/2017 |
| KR | 10-2005-0012003 | A | 1/2005 |
| KR | 10-2010-0015219 | A | 2/2010 |
| TW | I755124 | B | 2/2022 |

* cited by examiner

SANITARY WASHING DEVICE

CROSS-REFERENCE TO RELATED APPLICATIONS

This application is based upon and claims the benefit of priority from Japanese Patent Application No. 2022-097336, filed on Jun. 16, 2022; the entire contents of which are incorporated herein by reference.

FIELD

Embodiments described herein relate generally to a sanitary washing device.

BACKGROUND

In a known sanitary washing device that includes a nozzle discharging wash water for a private part wash, a heat exchanger uses AC power to heat the wash water. In such a sanitary washing device, for example, a switching element such as a triac or the like switches the supply state of the AC power to the heat exchanger. Normally, such a switching element is controlled by a controller that is operated, similarly to the functional units included in the sanitary washing device, by DC power.

In sanitary washing devices of recent years, it is desirable to make the casing smaller to improve the designability. To make the casing smaller while storing the various functional units within, it may be considered to mount the switching element and the controller, which are conventionally mounted on separate control boards, on one control board. However, the switching control by the switching element generates heat; and the heat from the switching element may affect the controller if the switching element and the controller are mounted on one control board.

SUMMARY

According to the embodiment, a sanitary washing device includes a nozzle, a heat exchanger, a cold water flow channel, a switching element, a control board, a heat transfer plate, and a casing. The nozzle discharges wash water for a private part wash. The heat exchanger uses alternating current power to heat the wash water supplied to the nozzle. The cold water flow channel supplies the wash water to the heat exchanger from a water supply source. The switching element switches a supply state of the alternating current power to the heat exchanger. A controller is mounted to the control board. The controller is operated by direct current power. The controller controls the switching element. The heat transfer plate is configured to dissipate heat of the switching element. The casing stores the nozzle, the heat exchanger, the cold water flow channel, the switching element, the control board, and the heat transfer plate. The switching element is mounted to the control board. The cold water flow channel includes a cooling part. The cooling part water-cools the heat transfer plate.

DETAILED DESCRIPTION

Figure 1:
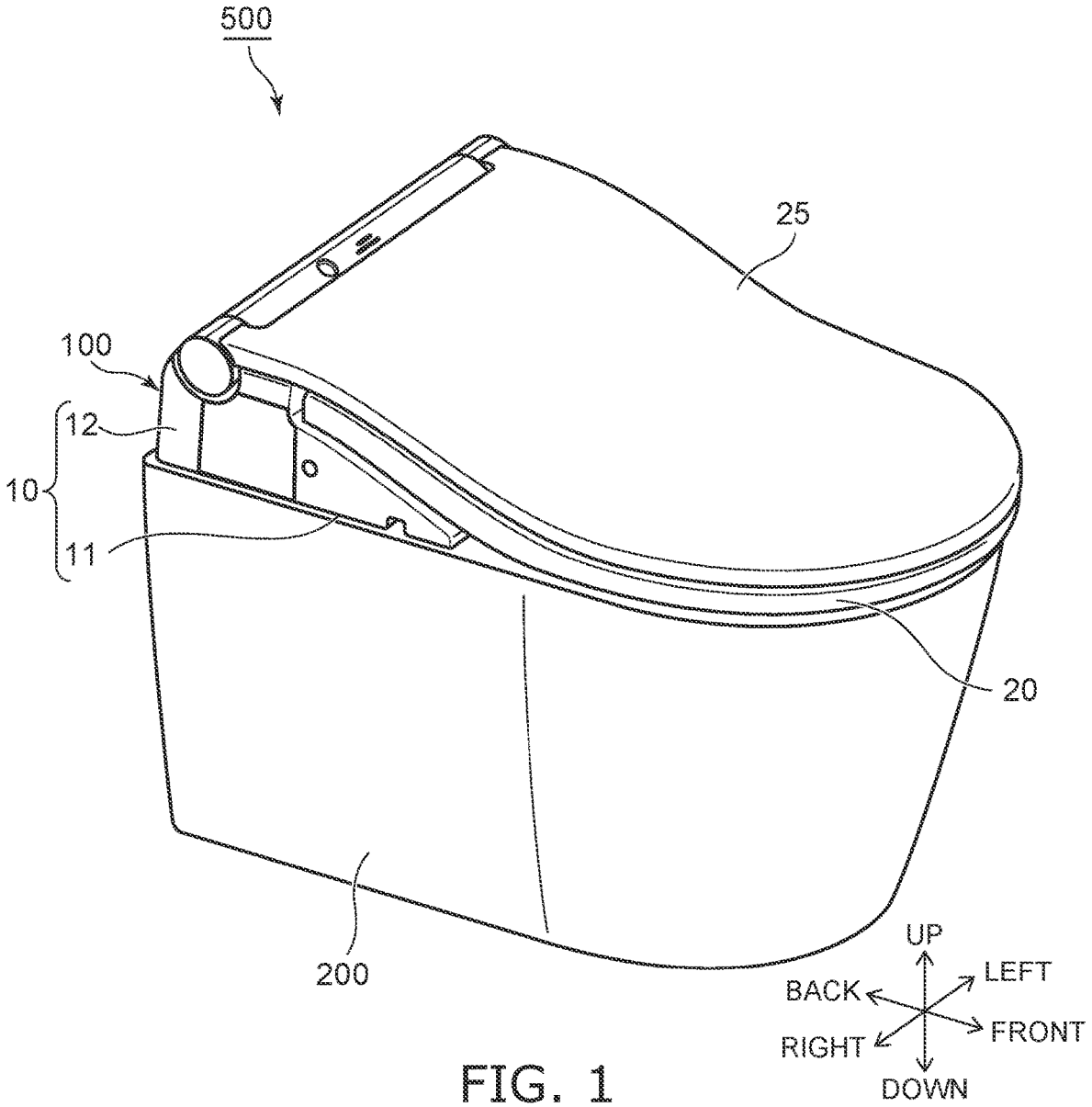
FIG. 1 is a perspective view illustrating a toilet device that includes a sanitary washing device according to an embodiment.

A first invention is a sanitary washing device, including a nozzle discharging wash water for a private part wash, a heat exchanger using AC power to heat the wash water supplied to the nozzle, a cold water flow channel supplying the wash water to the heat exchanger from a water supply source, a switching element switching a supply state of the AC power to the heat exchanger, a control board to which a controller is mounted, a heat transfer plate configured to dissipate heat of the switching element, and a casing storing the nozzle, the heat exchanger, the cold water flow channel, the switching element, the control board, and the heat transfer plate, wherein the controller is operated by DC power and controls the switching element, the switching element is mounted to the control board, and the cold water flow channel includes a cooling part that water-cools the heat transfer plate.

According to the sanitary washing device, by mounting the switching element to the control board to which the controller is mounted, the number of components can be reduced and the casing can be made smaller than when the switching element and the controller are mounted to separate control boards. Also, the heat of the switching element can be effectively dissipated by providing a heat transfer plate for dissipating the heat of the switching element and by providing a cooling part that water-cools the heat transfer plate. Accordingly, the effects of the heat from the switching element on the controller can be suppressed even when the switching element and the controller are mounted to one control board. Because the cold water flow channel includes a cooling part, the heat transfer plate can be water-cooled by utilizing wash water supplied from the water supply source to the heat exchanger before being heated. Accordingly, it is unnecessary to separately provide a part to cool the heat transfer plate; and the casing can be made smaller. The heat transfer plate (the switching element) can be cooled more efficiently when the heat transfer plate is water-cooled than when the heat transfer plate is air-cooled.

A second invention is the sanitary washing device of the first invention, wherein the heat exchanger is an instantaneous heat exchanger, and a distance between the heat exchanger and the switching element is greater than a distance between the cooling part and the switching element.

According to the sanitary washing device, by setting the distance between the heat exchanger and the switching element to be greater than the distance between the cooling part and the switching element, the heat exchanger, i.e., a heat source, can be located distant to the switching element, and the cooling part can be located proximate to the switching element. The effects of the heat from the heat exchanger on the controller mounted to the same control board as the switching element can be suppressed thereby. Also, by not positioning the heat exchanger between the cooling part and the switching element, the heating of the water flowing through the cooling part by the heat from the heat exchanger can be suppressed. The heat transfer plate (the switching element) can be more efficiently cooled thereby.

A third invention is the sanitary washing device of the first or second invention, wherein the casing includes a substrate storage part configured to store the control board in an upright state, the substrate storage part is located at a back part of the casing, and the switching element is mounted to a lower part of the control board.

According to the sanitary washing device, for example, when the height of the back of the casing is greater than the height of the front of the casing, the casing can be prevented from becoming larger by providing the substrate storage part that can store the control board in an upright state at the back part of the casing; and the space inside the casing can be effectively used. Because it is common for the cold water flow channel to be located at the lower part of the casing, the cooling part can be made smaller by mounting the switching element to the lower part of the control board in the upright state compared to when the switching element is mounted to the upper part of the control board in the upright state. The casing can be made smaller thereby.

A fourth invention is the sanitary washing device of the third invention, further including a valve unit located in the cold water flow channel, wherein the heat transfer plate is located at a position at which the heat transfer plate overlaps the valve unit in a longitudinal direction, and the switching element is located at a position at which the switching element overlaps the heat transfer plate in the longitudinal direction.

According to the sanitary washing device, by providing the heat transfer plate at a position at which the heat transfer plate overlaps the valve unit in the longitudinal direction and by providing the switching element at a position at which the switching element overlaps the heat transfer plate in the longitudinal direction, the cooling part can be made smaller than when the heat transfer plate is located at a position at which the heat transfer plate does not overlap the valve unit in the longitudinal direction or when the switching element is located at a position at which the switching element does not overlap the heat transfer plate in the longitudinal direction. The casing can be made smaller thereby.

A fifth invention is the sanitary washing device of the third invention, wherein the casing includes a water receiving part, at least a portion of the water receiving part is positioned below the heat transfer plate, the water receiving part is configured to receive condensation water generated at the heat transfer plate, and the heat transfer plate is inclined downward from the switching element toward the water receiving part.

According to the sanitary washing device, the flow of the condensation water generated at the heat transfer plate toward the control board side can be suppressed by providing the water receiving part, which is configured to receive the condensation water generated at the heat transfer plate, below the heat transfer plate, and by setting the heat transfer plate to be inclined downward from the switching element toward the water receiving part. Malfunction of the control board due to condensation water can be suppressed thereby.

A sixth invention is the sanitary washing device of the third invention, further including a toilet lid, and a toilet lid opening/closing part configured to open and close the toilet lid, wherein the control board is located at one side of the casing in a lateral direction, and the toilet lid opening/closing part is located at another side of the casing in the lateral direction.

According to the sanitary washing device, the space inside the casing can be effectively used by providing the control board at one side of the casing in the lateral direction and by providing the toilet lid opening/closing part at the other side of the casing in the lateral direction. The casing can be made smaller thereby.

Hereinafter, embodiments of the invention will be described with reference to the drawings. It is noted that, in each figure, similar components are denoted by the same reference numerals, and detailed description thereof will be omitted as appropriate.

FIG. 1 is a perspective view illustrating a toilet device that includes a sanitary washing device according to an embodiment.

As illustrated in FIG. 1, the toilet device 500 according to the embodiment includes the sanitary washing device 100 and a western-style sit-down toilet (for convenience of description hereinbelow, called, simply the "toilet") 200. The sanitary washing device 100 is located on the toilet 200. The sanitary washing device 100 includes a casing 10, a toilet seat 20, and a toilet lid 25.

In this specification, "up", "down", "front", "back", "right", and "left" are directions when viewed by a user sitting on the toilet seat 20 as illustrated in FIG. 1.

The casing 10 includes a case plate 11 and a case cover 12. The case plate 11 is positioned at the lower part of the casing 10. The case plate 11 is placed on the back part of the toilet 200. The case cover 12 is located on the case plate 11 and covers the case plate 11 from above. The space of the casing 10 surrounded with the case plate 11 and the case cover 12 stores functional units such as a nozzle 30 described below, etc.

The toilet seat 20 is pivotally supported to be openable and closable with respect to the casing 10 via a toilet seat opening/closing part 21 described below. The toilet lid 25 is pivotally supported to be openable and closable with respect to the casing 10 via a toilet lid opening/closing part 26 described below. FIG. 1 illustrates a state in which the toilet seat 20 and the toilet lid 25 are closed. The toilet lid 25 covers the toilet seat 20 from above in the state in which the toilet seat 20 and the toilet lid 25 are closed.

Figure 2:
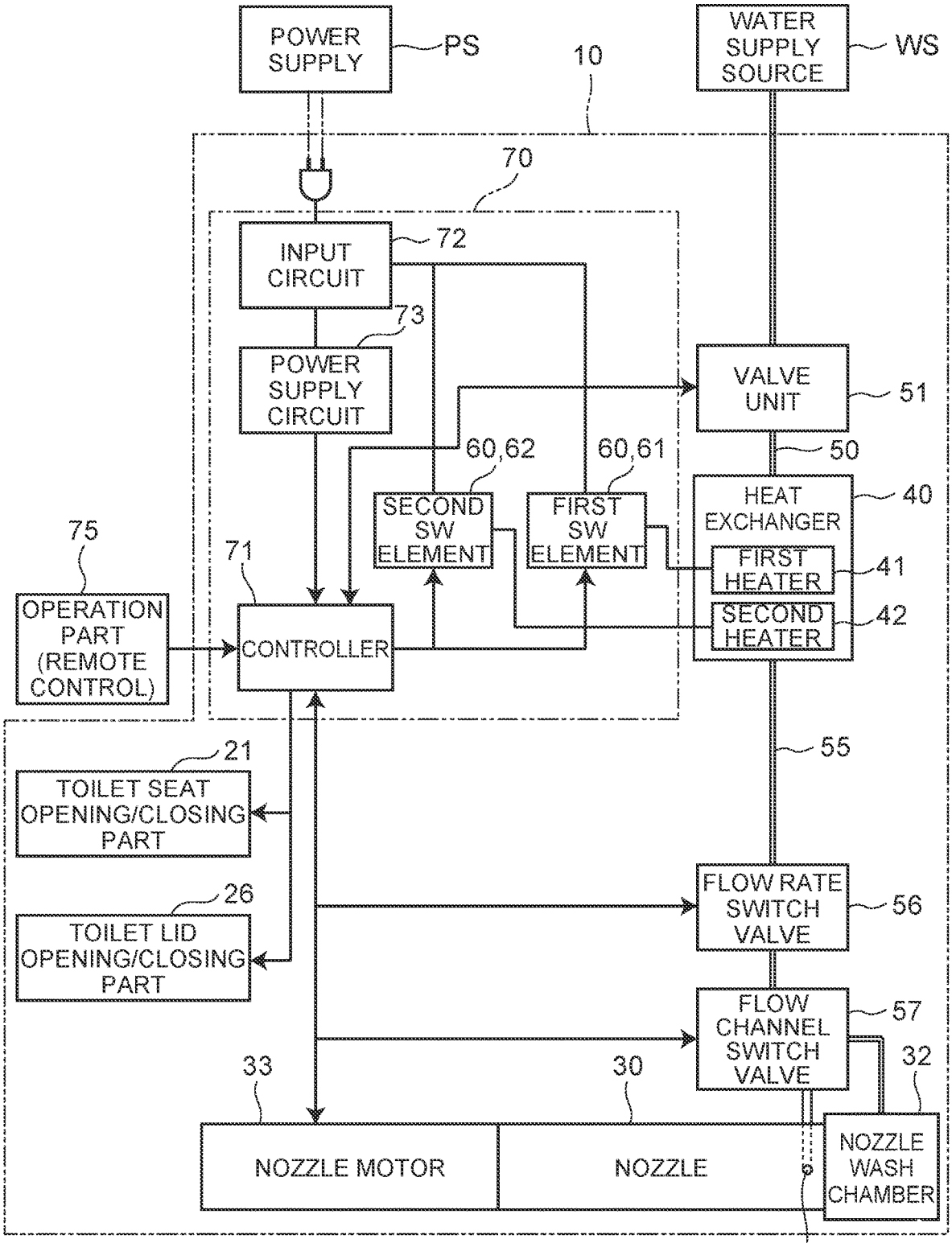
FIG. 2 is a block diagram illustrating relevant components of the sanitary washing device according to the embodiment.

FIG. 2 is a block diagram illustrating relevant components of the sanitary washing device according to the embodiment.

In FIG. 2, the relevant components of the water channel system and the relevant components of the electrical system of the sanitary washing device 100 are illustrated together.

As illustrated in FIG. 2, the sanitary washing device 100 includes the nozzle 30, a heat exchanger 40, a cold water flow channel 50, a warm water flow channel 55, a switching element 60, and a control board 70. The nozzle 30, the heat exchanger 40, the cold water flow channel 50, the warm water flow channel 55, the switching element 60, the control board 70, etc., are stored inside the casing 10.

The nozzle 30 discharges wash water for a private part wash. A discharge port 31 for discharging the wash water is provided in the tip portion of the nozzle 30. The nozzle 30 discharges, through the discharge port 31, the wash water supplied from a water supply source WS such as a service water line, a water storage tank, or the like to wash a private part (e.g., the "bottom" or the like) of a user sitting on the toilet seat 20.

A nozzle wash chamber 32 is located at the periphery of the nozzle 30. The nozzle wash chamber 32 can sterilize or wash the outer circumferential surface (the body) of the nozzle 30 by discharging sterilizing water or wash water from a not-illustrated water discharger provided inside the nozzle wash chamber 32. The nozzle wash chamber 32 can sterilize or wash the discharge port 31 part of the nozzle 30 in a state in which the nozzle 30 is stored inside the casing 10.

The nozzle 30 advances and retracts due to the drive force of a nozzle motor 33. The drive force of the nozzle motor 33 causes the nozzle 30 to advance into the bowl of the toilet 200 or causes the nozzle 30 to retreat into the casing 10. The nozzle 30 is stored inside the casing 10 in the retracted state.

The heat exchanger 40 uses AC power to heat the wash water supplied to the nozzle 30. The heat exchanger 40 is, for example, a ceramic heater. The heat exchanger 40 is, for example, an instantaneous heat exchanger that does not include a tank. An instantaneous heat exchanger heats the water flowing through the interior without filling a tank or the like with water. The heat exchanger 40 may be, for example, a hot water storage-type heat exchanger that includes a tank. The hot water storage-type heat exchanger heats water stored in a tank.

In the example, the heat exchanger 40 includes a first heater 41 and a second heater 42. The first heater 41 is, for example, a main heater having a large output. The second heater 42 is, for example, a sub-heater having a small output. The resistance value of the second heater 42 is, for example, less than the resistance value of the first heater 41. The heat exchanger 40 uses the first heater 41 and the second heater 42 to heat the wash water supplied from the water supply source WS. The number of heaters provided in the heat exchanger 40 is not limited to two and may be one, three, or more.

The cold water flow channel 50 supplies the wash water from the water supply source WS to the heat exchanger 40. The cold water flow channel 50 is located between the water supply source WS and the heat exchanger 40 and connects the water supply source WS and the heat exchanger 40. Wash water (cold water) before being heated by the heat exchanger 40 flows in the cold water flow channel 50. The cold water flow channel 50 is a flow channel at the upstream side of the heat exchanger 40.

A valve unit 51 is located in the cold water flow channel 50. The valve unit 51 is an electrically controllable valve. The valve unit 51 opens and closes to control the start and stop of the supply of the wash water from the water supply source WS to the heat exchanger 40. The valve unit 51 includes, for example, an electromagnetic valve. The valve unit 51 may include, for example, an electromagnetic valve and a pressure reducing valve.

The warm water flow channel 55 supplies the wash water from the heat exchanger 40 to the nozzle 30. The warm water flow channel 55 is located between the heat exchanger 40 and the nozzle 30 and connects the heat exchanger 40 and the nozzle 30. The wash water (the warm water) after being heated by the heat exchanger 40 flows in the warm water flow channel 55. The warm water flow channel 55 is a flow channel at the downstream side of the heat exchanger 40.

A flow rate switch valve 56 that regulates the flow rate and a flow channel switch valve 57 that starts and stops the water supply to the nozzle 30 and the nozzle wash chamber 32 and switches the water supply destination are located in the warm water flow channel 55. The flow rate switch valve 56 regulates the flow rate of the water flowing toward the nozzle 30. The flow channel switch valve 57 can switch the water supply destination (the connection destination of the warm water flow channel 55) to one of the nozzle 30 or the nozzle wash chamber 32. The flow rate switch valve 56 and the flow channel switch valve 57 may be provided as one unit.

The switching element 60 switches the supply state of the AC power to the heat exchanger 40. More specifically, the switching element 60 switches the supply state of the AC power to the heater of the heat exchanger 40. The switching element 60 switches between a state in which AC power is supplied to the heater of the heat exchanger 40, and a state in which AC power is not supplied to the heater of the heat exchanger 40 (i.e., a state in which the supply of the AC power to the heater is stopped). The switching element 60 thereby controls the start and stop of the heating of the heat exchanger 40.

The switching element 60 is, for example, a semiconductor switch. The switching element 60 includes, for example, a thyristor or a triac. The switching element 60 may be, for example, any element that can control the on/off of the current and can allow the current to flow in at least one direction. For example, the switching element 60 may be configured by combining multiple semiconductor switches, etc.

In the example, the switching element 60 includes a first switching element 61 and a second switching element 62. The first switching element 61 is electrically connected with the first heater 41 and switches the supply state of the AC power to the first heater 41. The second switching element 62 is electrically connected with the second heater 42 and switches the supply state of the AC power to the second heater 42. It is sufficient for the number of the switching elements 60 to be equal to the number of heaters included in the heat exchanger 40; the number of the switching elements 60 is not limited to two and may be one, three, or more.

The sanitary washing device 100 includes the toilet seat opening/closing part 21 and the toilet lid opening/closing part 26. The toilet seat opening/closing part 21 includes, for example, an electric opening/closing unit for electrically opening and closing the toilet seat 20. The toilet seat opening/closing part 21 may include, for example, a damper mechanism for slowly opening and closing the toilet seat 20. The toilet lid opening/closing part 26 includes, for example, an electric opening/closing unit for electrically opening and closing the toilet lid 25. The toilet lid opening/closing part 26 may include, for example, a damper mechanism for slowly opening and closing the toilet lid 25. The toilet seat opening/closing part 21 and the toilet lid opening/closing part 26 are provided as necessary and are omissible.

A controller 71 for controlling the components of the sanitary washing device 100 described above is mounted to the control board 70. The controller 71 is operated by DC power. The controller 71 is electrically connected with the switching element 60 (the first switching element 61 and the second switching element 62) and controls the switching element 60 (the first switching element 61 and the second switching element 62). For example, the controller 71 is electrically connected with the valve unit 51 and controls the valve unit 51. For example, the controller 71 is electrically connected with the flow rate switch valve 56 and the flow channel switch valve 57 and controls the flow rate switch valve 56 and the flow channel switch valve 57. For example, the controller 71 is electrically connected with the nozzle motor 33 and controls the nozzle motor 33. For example, the controller 71 is electrically connected with the toilet seat opening/closing part 21 and the toilet lid opening/closing part 26 and controls the toilet seat opening/closing part 21 and the toilet lid opening/closing part 26.

For example, by operating an operation part 75, the user can start and stop the discharge of the wash water from the nozzle 30. For example, by operating the operation part 75, the user can set the temperature of the wash water heated in the heat exchanger 40. The operation part 75 is, for example, a remote control used by being mounted to a wall of a toilet room, etc. The operation part 75 may be, for example, an operation panel formed to have a continuous body with the casing 10 of the sanitary washing device 100, etc.

AC power from a power supply PS is supplied to the heat exchanger 40. The power supply PS is an AC power supply. The power supply PS is, for example, a commercial power source of AC 100 V (effective value).

The AC power from the power supply PS is supplied to the heat exchanger 40 via an input circuit 72. The input circuit 72 is located on the path between the power supply PS and the heater of the heat exchanger 40. The heater (the first heater 41 and the second heater 42) of the heat exchanger 40 is connected to the input circuit 72 via the switching element 60 (the first switching element 61 and the second switching element 62).

A portion of the AC power supplied from the power supply PS to the input circuit 72 is supplied to the heater (the first heater 41 and the second heater 42) of the heat exchanger 40 via the switching element 60 (the first switching element 61 and the second switching element 62). The AC power that is supplied from the power supply PS (the input circuit 72) is supplied by the first switching element 61 to the first heater 41 in the on-state. In the off-state, the first switching element 61 stops the supply to the first heater 41 of the AC power supplied from the power supply PS (the input circuit 72). The AC power that is supplied from the power supply PS (the input circuit 72) is supplied by the second switching element 62 to the second heater 42 in the on-state. In the off-state, the second switching element 62 stops the supply to the second heater 42 of the AC power supplied from the power supply PS (the input circuit 72).

Another portion of the AC power supplied from the power supply PS to the input circuit 72 is converted into DC power by a power supply circuit 73 and supplied to the controller 71. The power supply circuit 73 is located on the path between the input circuit 72 and the controller 71, converts the AC power supplied from the power supply PS into DC power, and supplies the DC power after the conversion to the controller 71. For example, the controller 71 operates based on the DC power supplied from the power supply circuit 73.

The input circuit 72 and the power supply circuit 73 are located at the control board 70. The input circuit 72 and the power supply circuit 73 supply a portion of the AC power supplied from the power supply PS to the heat exchanger 40 as AC power, and supply another portion of the AC power supplied from the power supply PS to the controller 71 as DC power.

The controller 71 may operate based on DC power supplied from a DC power supply (e.g., a battery or the like) other than the power supply PS. In such a case, the power supply circuit 73 is omissible.

According to the embodiment, the switching element 60 is mounted to the control board 70. In other words, the switching element 60 and the controller 71 are mounted to the same one control board 70. Thus, by mounting the switching element 60 to the control board 70 to which the controller 71 is mounted, the number of components can be reduced and the casing 10 can be made smaller than when the switching element 60 and the controller 71 are mounted to separate control boards.

On the other hand, the switching element 60 generates heat due to the control of switching the supply state of the AC power to the heat exchanger 40. Therefore, there is a risk that the controller 71 may be affected by the heat from the switching element 60 when the switching element 60 and the controller are mounted to one control board 70. Therefore, according to the embodiment, a cooling mechanism for cooling the switching element 60 is provided.

The cooling mechanism for cooling the switching element 60 will now be described.

Figure 3:
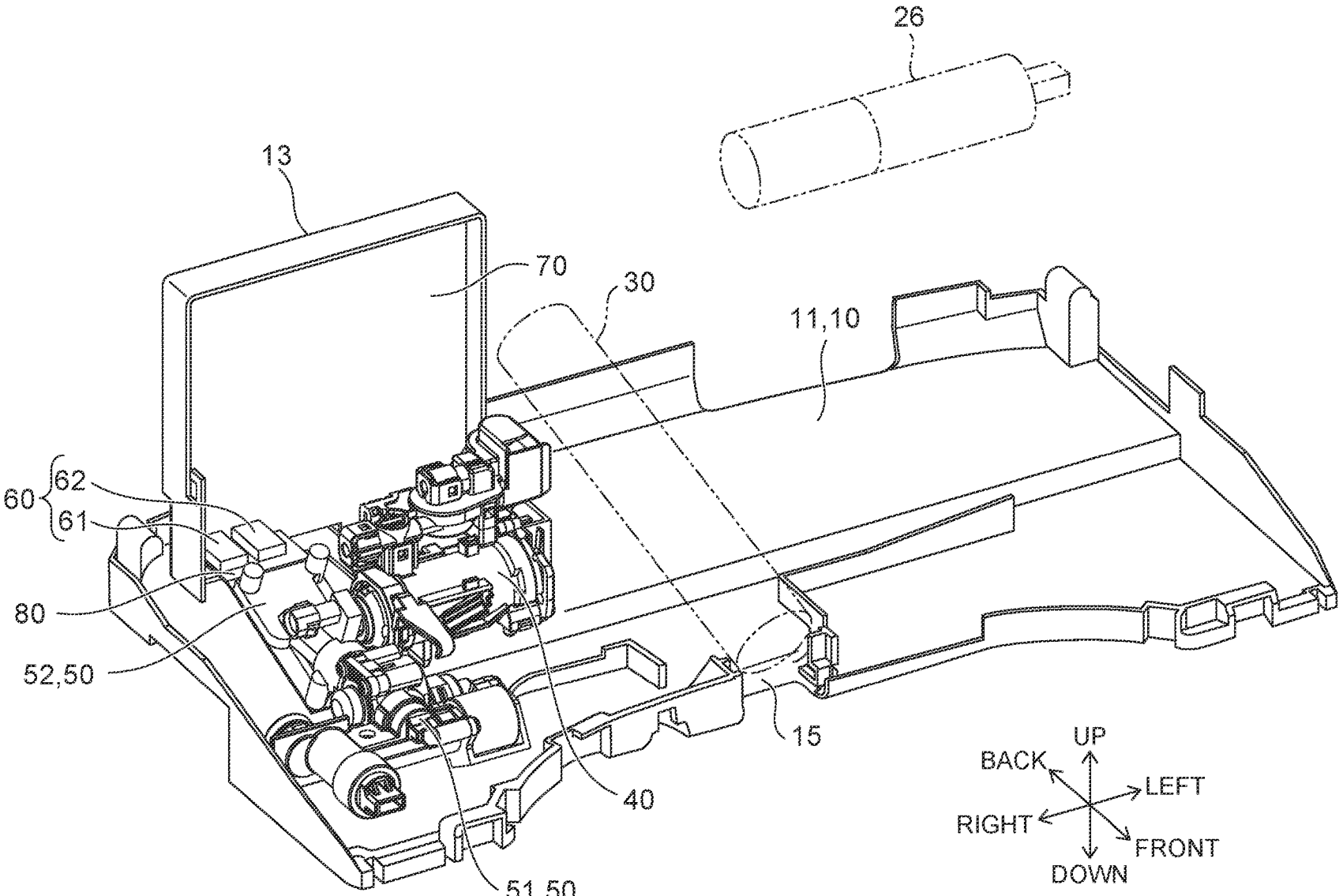
FIG. 3 is a perspective view illustrating a portion of the sanitary washing device according to the embodiment.

FIG. 3 is a perspective view illustrating a portion of the sanitary washing device according to the embodiment.

Figure 4:
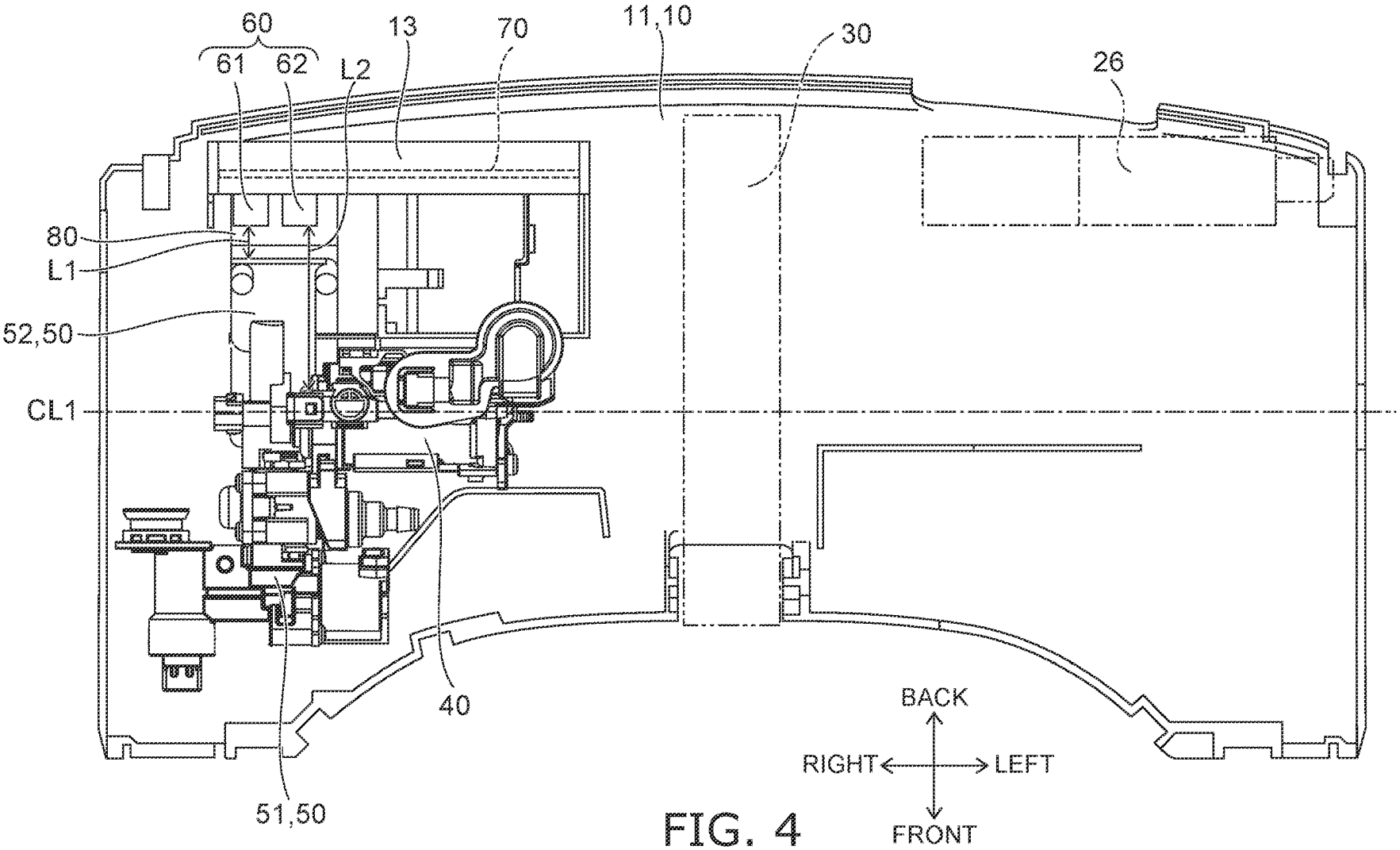
FIG. 4 is a plan view illustrating a portion of the sanitary washing device according to the embodiment.

FIG. 4 is a plan view illustrating a portion of the sanitary washing device according to the embodiment.

Figure 5:
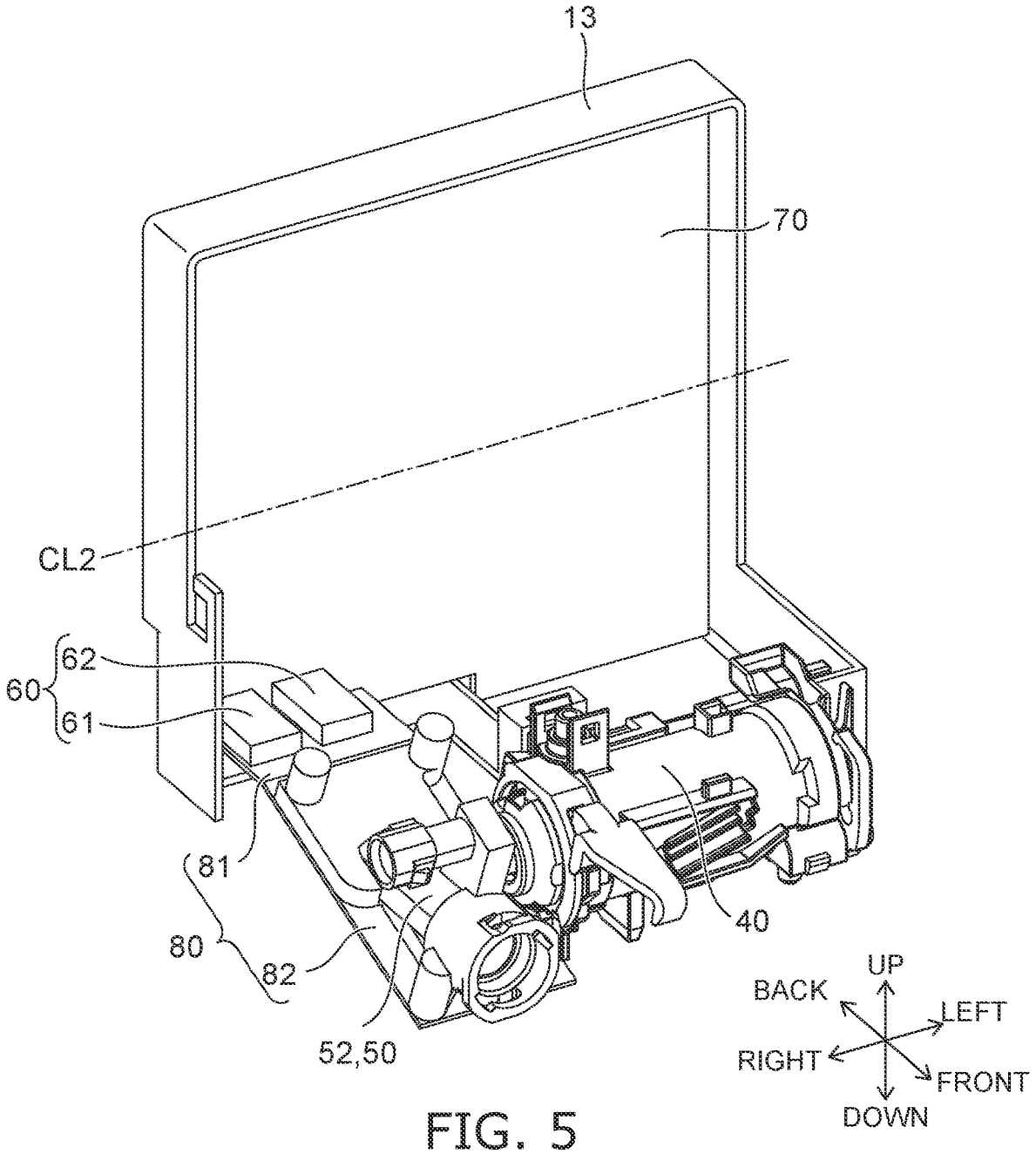
FIG. 5 is a perspective view illustrating the periphery of the switching element of the sanitary washing device according to the embodiment.

FIG. 5 is a perspective view illustrating the periphery of the switching element of the sanitary washing device according to the embodiment.

FIGS. 3 and 4 illustrate the state in which the case cover 12 is removed.

As illustrated in FIGS. 3 to 5, a heat transfer plate 80 for dissipating the heat of the switching element 60 is located below the switching element 60.

The heat transfer plate 80 is, for example, a plate made of metal. In the example, the heat transfer plate 80 is fixed with respect to the switching element 60 and contacts the switching element 60. It is sufficient for the heat transfer plate 80 to be located in the vicinity of the switching element 60 (e.g., a position to which the heat of the switching element 60 is conducted); the heat transfer plate 80 may not contact the switching element 60. The heat transfer plate 80 may not be fixed with respect to the switching element 60.

The heat transfer plate 80 includes a first part 81 and a second part 82. For example, the first part 81 extends substantially horizontally frontward from the control board 70. For example, the first part 81 is positioned below the switching element 60. The first part 81 is fixed with respect to the switching element 60 and contacts the switching element 60. For example, the first part 81 is fixed to the switching element 60 from below by screwing, etc. The second part 82 extends to be inclined downward and frontward from the first part 81.

The cold water flow channel 50 includes a cooling part 52 that water-cools the heat transfer plate 80. The cooling part 52 is fixed with respect to the second part 82 of the heat transfer plate 80 and contacts the second part 82 of the heat transfer plate 80. In the example, the cooling part 52 is located between the valve unit 51 and the heat exchanger 40. That is, in the example, the cooling part 52 is located downstream of the valve unit 51. The cooling part 52 may be located upstream of the valve unit 51.

The wash water that is supplied from the water supply source WS to the cold water flow channel 50 passes through the valve unit 51 and the cooling part 52 and is supplied to the heat exchanger 40. At this time, the heat transfer plate 80 that absorbs heat from the switching element 60 is water-cooled by the cooling part 52 due to the wash water passing through the cooling part 52. That is, the heat transfer plate 80 and the cooling part 52 function as a heat sink for dissipating the heat of the switching element 60.

The heat of the switching element 60 can be effectively dissipated by providing the heat transfer plate 80 for dissipating the heat of the switching element 60 and by providing the cooling part 52 that water-cools the heat transfer plate 80. Accordingly, the effects of the heat from the switching element 60 on the controller 71 can be suppressed even when the switching element 60 and the controller 71 are mounted to one control board 70. Because the cold water flow channel 50 includes the cooling part 52, the wash water from the water supply source WS that is to be supplied to the heat exchanger 40 can be utilized to cool the heat transfer plate 80 before being heated. Accordingly, it is unnecessary to separately provide a part that cools the heat transfer plate 80; and the casing 10 can be made smaller. The heat transfer plate 80 (the switching element 60) can be cooled more efficiently by water-cooling the heat transfer plate 80 than by air-cooling the heat transfer plate 80.

It is favorable for the heat exchanger 40 to be located distant to the switching element 60. It is favorable for the cooling part 52 to be located proximate to the switching element 60. More specifically, it is favorable for a distance L2 between the heat exchanger 40 and the switching element 60 to be greater than a distance L1 between the cooling part 52 and the switching element 60.

By setting the distance L2 to be greater than the distance L1, the heat exchanger 40, i.e., a heat source, can be located distant to the switching element 60, and the cooling part 52 can be located proximate to the switching element 60. The effects of the heat from the heat exchanger 40 on the controller 71 mounted to the same control board 70 as the switching element 60 can be suppressed thereby. Because the heat exchanger 40 can be prevented from being positioned between the cooling part 52 and the switching element 60, the heating of the water flowing through the cooling part 52 by the heat from the heat exchanger 40 can be suppressed. The heat transfer plate 80 (the switching element 60) can be more efficiently cooled thereby.

The casing 10 includes a substrate storage part 13 configured to store the control board 70 in the upright state. For example, the control board 70 is located so that the surface on which the circuit is formed faces the longitudinal direction. For example, the control board 70 is located so that the surface to which the switching element 60 is mounted faces frontward. The control board 70 may be located along the vertical direction or may be inclined frontward or backward with respect to the vertical direction. When the control board 70 is inclined, it is favorable for the incline angle to be not more than 45 degrees with respect to the vertical direction, more favorably not more than 30 degrees with respect to the vertical direction, and more favorably not more than 15 degrees with respect to the vertical direction.

For example, the substrate storage part 13 (the control board 70) is located at the back part of the casing 10. For example, at least a portion of the substrate storage part 13 is positioned further backward than a longitudinal-direction center CL1 of the casing 10. For example, the front end of the substrate storage part 13 is positioned further backward than the longitudinal-direction center CL1 of the casing 10.

For example, when the height at the back of the casing 10 is greater than the height at the front of the casing 10, an enlargement of the casing 10 can be suppressed and the space inside the casing 10 can be effectively used by providing the substrate storage part 13 configured to store the control board 70 in the upright state at the back part of the casing 10.

For example, the substrate storage part 13 (the control board 70) is located at one side of the casing 10 in the lateral direction. For example, the toilet lid opening/closing part 26 is located at the other side of the casing 10 in the lateral direction. In the example, the substrate storage part 13 (the control board 70) is located at the right side of the casing 10; and the toilet lid opening/closing part 26 is located at the left side of the casing 10. For example, the substrate storage part 13 (the control board 70) is located at the side opposite to the toilet lid opening/closing part 26 in the lateral direction with the nozzle 30 interposed.

The space inside the casing 10 can be effectively used by providing the control board 70 at one side of the casing 10 in the lateral direction and by providing the toilet lid opening/closing part 26 at the other side of the casing 10 in the lateral direction. The casing 10 can be made smaller thereby.

The switching element 60 is provided to protrude frontward from the control board 70. The first switching element 61 and the second switching element 62 are arranged in the lateral direction on the control board 70.

For example, the switching element 60 is mounted to the lower part of the control board 70. For example, at least a portion of the switching element 60 is positioned lower than a vertical-direction center CL2 of the control board 70. For example, the upper end of the switching element 60 is positioned lower than the vertical-direction center CL2 of the control board 70.

Because it is common for the cold water flow channel 50 to be located at the lower part of the casing 10, the cooling part 52 can be made smaller by mounting the switching element 60 at the lower part of the control board 70 in the upright state compared to when the switching element 60 is mounted at the upper part of the control board 70 in the upright state. The casing 10 can be made smaller thereby.

For example, the heat transfer plate 80 is located at a position at which the heat transfer plate 80 overlaps the valve unit 51 in the longitudinal direction. For example, the switching element 60 is located at a position at which the switching element 60 overlaps the heat transfer plate 80 in the longitudinal direction. For example, the heat transfer plate 80 is located between the valve unit 51 and the switching element 60 in the longitudinal direction.

By providing the heat transfer plate 80 at a position at which the heat transfer plate 80 overlaps the valve unit 51 in the longitudinal direction and by providing the switching element 60 at a position at which the switching element 60 overlaps the heat transfer plate 80 in the longitudinal direction, the cooling part 52 can be made smaller than when the heat transfer plate 80 is located at a position at which the heat transfer plate 80 does not overlap the valve unit 51 in the longitudinal direction, or when the switching element 60 is located at a position at which the switching element 60 does not overlap the heat transfer plate 80 in the longitudinal direction. The casing 10 can be made smaller thereby.

The flow of the wash water in the cooling part 52 will now be described in more detail.

Figure 6:
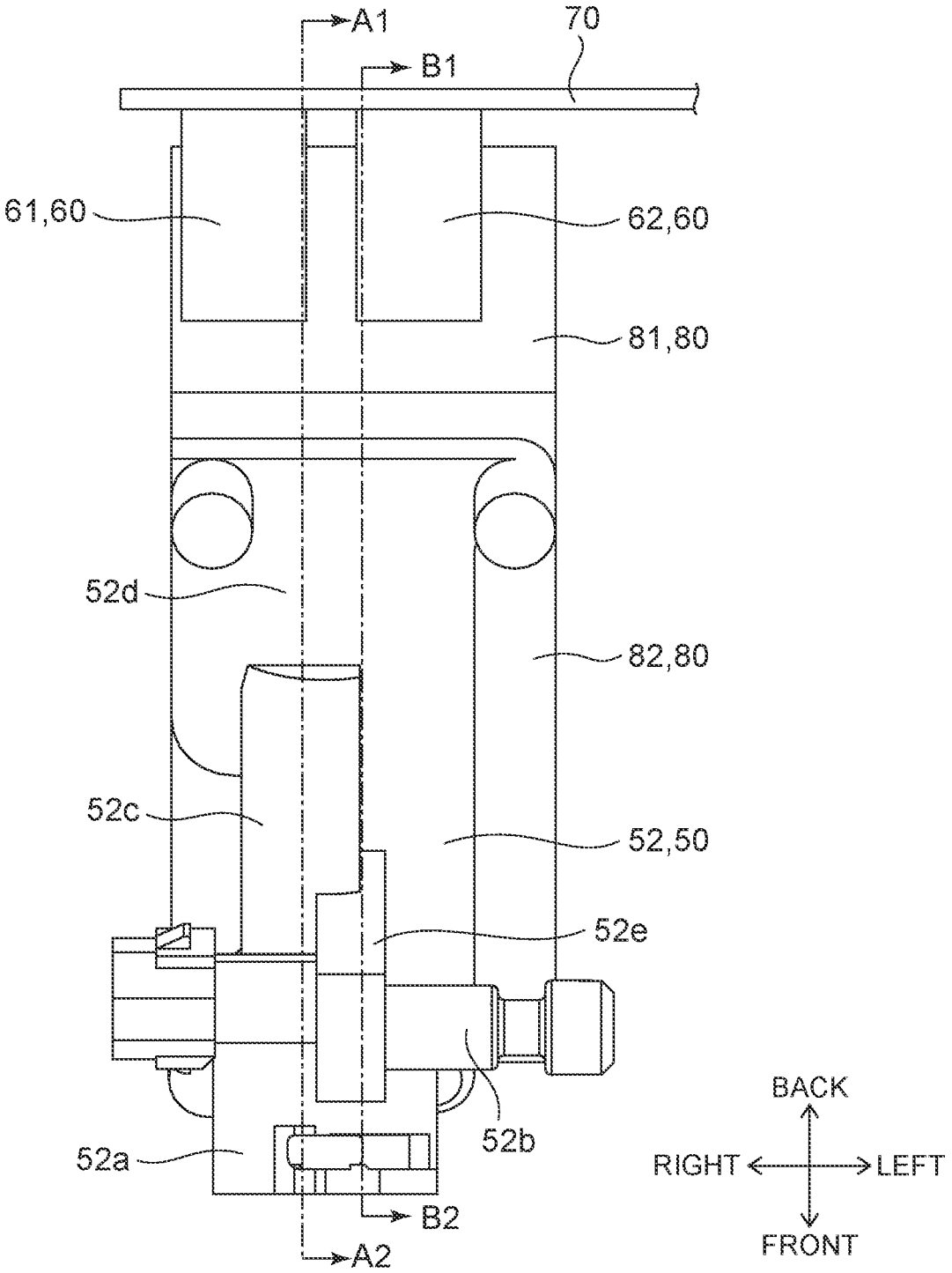
FIG. 6 is a plan view illustrating the periphery of the switching element of the sanitary washing device according to the embodiment.

FIG. 6 is a plan view illustrating the periphery of the switching element of the sanitary washing device according to the embodiment.

Figure 7:
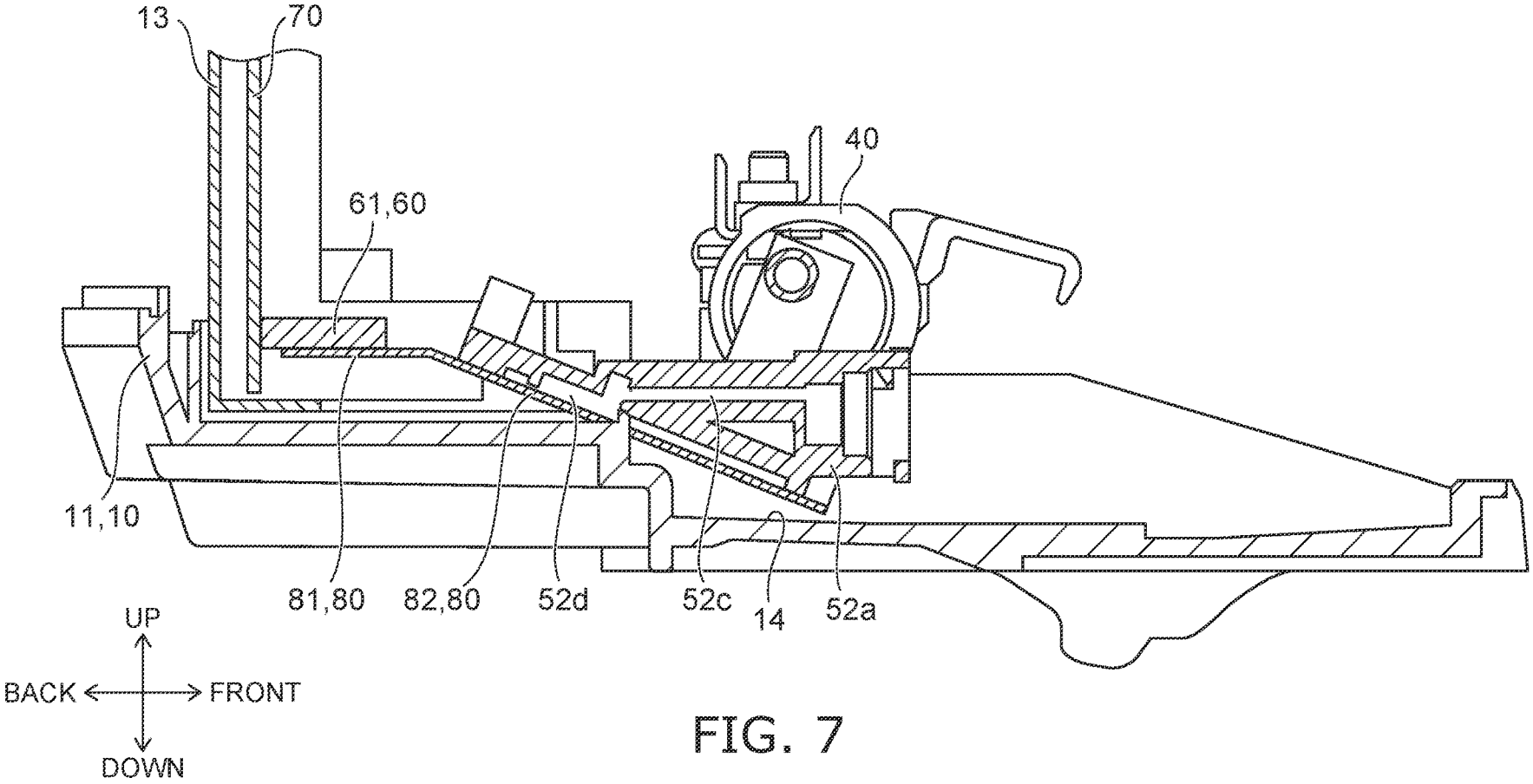
FIG. 7 is a cross-sectional view illustrating a portion of the sanitary washing device according to the embodiment.

FIG. 7 is a cross-sectional view illustrating a portion of the sanitary washing device according to the embodiment.

Figure 8:
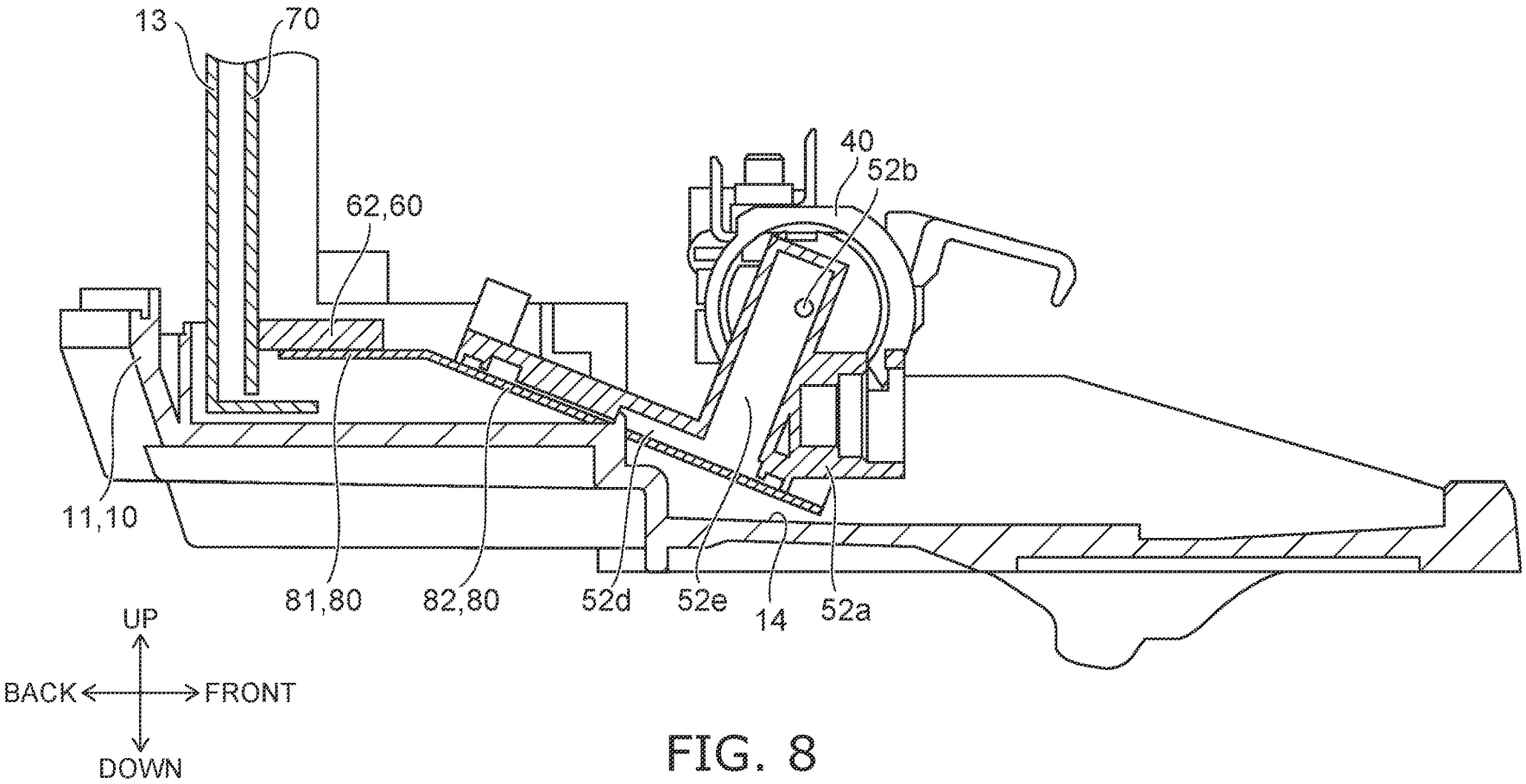
FIG. 8 is a cross-sectional view illustrating a portion of the sanitary washing device according to the embodiment.

FIG. 8 is a cross-sectional view illustrating a portion of the sanitary washing device according to the embodiment.

Figure 9:
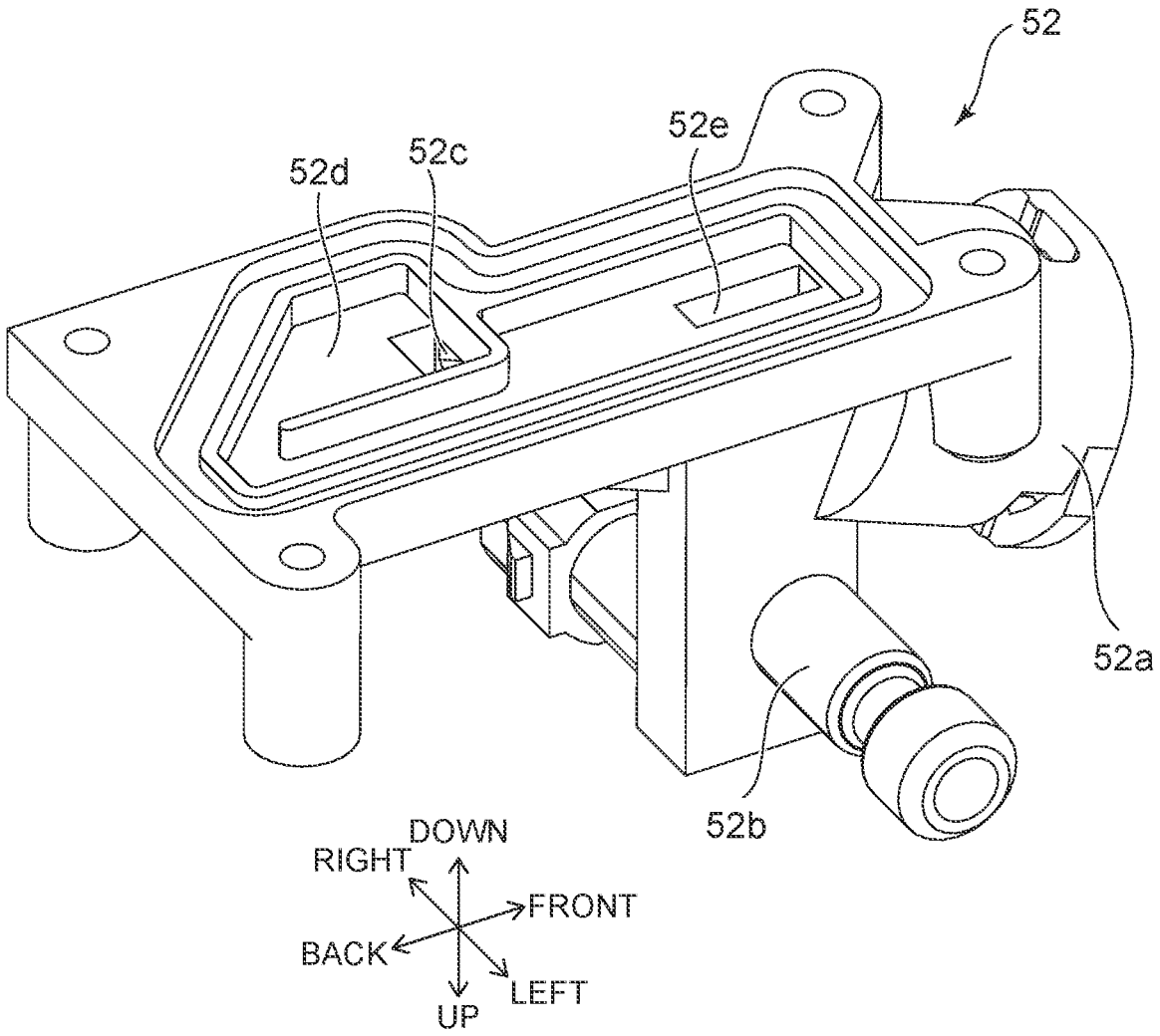
FIG. 9 is a perspective view illustrating a portion of the cold water flow channel of the sanitary washing device according to the embodiment.

FIG. 9 is a perspective view illustrating a portion of the cold water flow channel of the sanitary washing device according to the embodiment.

The substrate storage part 13 is not illustrated in FIG. 6.

FIG. 7 is a cross-sectional view along line A1-A2 shown in FIG. 6.

FIG. 8 is a cross-sectional view along line B1-B2 shown in FIG. 6.

As illustrated in FIGS. 6 to 9, the cooling part 52 includes an inflow part 52*a*, an outflow part 52*b*, and first to third flow channels 52*c* to 52*e*.

The inflow part 52*a* is located at the end part of the cooling part 52 at the upstream side. The outflow part 52*b* is located at the end part of the cooling part 52 at the downstream side. In the example, the outflow part 52*b* is connected with the heat exchanger 40. The first flow channel 52*c*, a second flow channel 52*d*, and the third flow channel 52*e* are located between the inflow part 52*a* and the outflow part 52*b*. The first to third flow channels 52*c* to 52*e* are arranged in the order of the first flow channel 52*c*, the second flow channel 52*d*, and the third flow channel 52*e* from the upstream side.

In the example, the first flow channel 52*c* extends substantially horizontally backward from the inflow part 52*a*. The second flow channel 52*d* detours backward from the connection part between the first flow channel 52*c* and the second flow channel 52*d* and then extends frontward. The connection part between the second flow channel 52*d* and the third flow channel 52*e* is positioned further frontward than the connection part between the first flow channel 52*c* and the second flow channel 52*d*. The third flow channel 52*e* extends upward and frontward from the connection part between the second flow channel 52*d* and the third flow channel 52*e*. The outflow part 52*b* extends substantially horizontally leftward from the upper part of the third flow channel 52*e*.

The water that flows in through the inflow part 52*a* passes through the first flow channel 52*c* and reaches the second flow channel 52*d*. The water that flows through the second flow channel 52*d* passes through the third flow channel 52*e*, reaches the outflow part 52*b*, and flows out to the heat exchanger 40.

The cooling part 52 contacts the second part 82 of the heat transfer plate 80 at the second flow channel 52*d*. The cooling part 52 water-cools the second part 82 of the heat transfer plate 80 by the water flowing through the second flow channel 52*d*. The cooling efficiency of the heat transfer plate 80 can be increased by providing the second flow channel 52*d* with the structure having the detour.

For example, the heat exchanger 40 is located at a position at which the heat exchanger 40 overlaps the cooling part 52 in the lateral direction. For example, the heat exchanger 40 is located at a position at which the heat exchanger 40 overlaps the inflow part 52*a* in the lateral direction.

Figure 10:
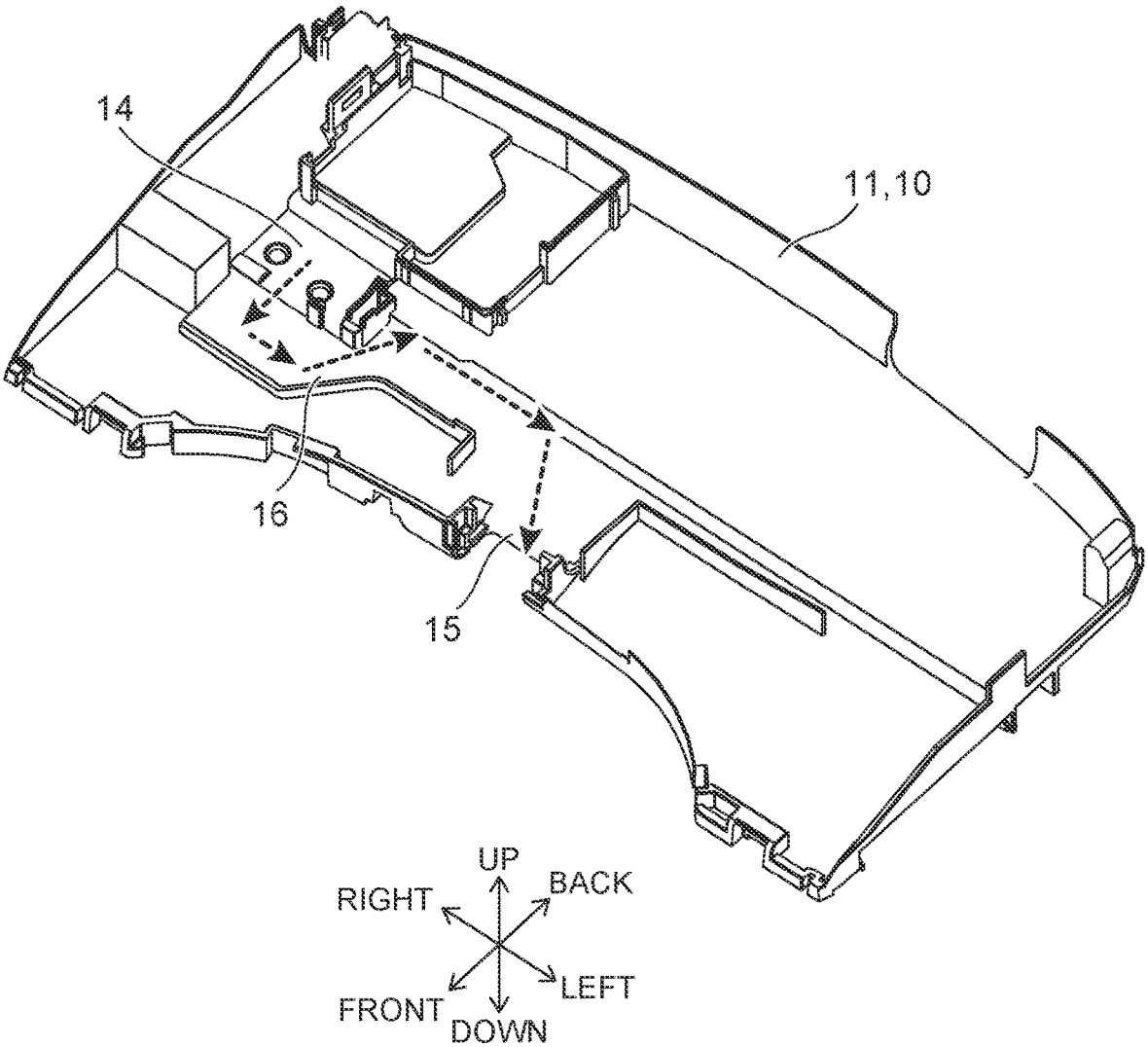
FIG. 10 is a perspective view illustrating a portion of the casing of the sanitary washing device according to the embodiment.

FIG. 10 is a perspective view illustrating a portion of the casing of the sanitary washing device according to the embodiment.

Only the case plate 11 is illustrated in FIG. 10.

As illustrated in FIG. 10, the case plate 11 includes a water receiving part 14 for receiving condensation water generated at the heat transfer plate 80.

As illustrated in FIGS. 7 and 8, at least a portion of the water receiving part 14 is positioned below the heat transfer plate 80 (the second part 82). The second part 82 of the heat transfer plate 80 is inclined downward from the switching element 60 toward the water receiving part 14. Accordingly, the condensation water that is generated at the heat transfer plate 80 is discharged into the water receiving part 14 via the second part 82.

The case plate 11 also includes a drain part 15 for draining the water on the case plate 11 into the bowl of the toilet 200, and a drain flow channel 16 connecting the water receiving part 14 and the drain part 15. Broken line arrows in FIG. 10 show the flow of the water when the water is received by the water receiving part 14, passes through the drain flow channel 16, and is drained through the drain part 15.

The drain flow channel 16 guides the water received by the water receiving part 14 to the drain part 15. For example, the drain flow channel 16 is inclined downward from the water receiving part 14 toward the drain part 15. In the example as illustrated in FIG. 3, the drain part 15 is located below the nozzle 30. The drain part 15 is not limited to such a configuration; it is sufficient for the drain part 15 to be located at a position at which the drain part 15 overlaps the bowl of the toilet 200 in the vertical direction.

The condensation water generated at the heat transfer plate 80 can be prevented from flowing toward the control board 70 side by providing the water receiving part 14 for receiving the condensation water generated at the heat transfer plate 80 below the heat transfer plate 80 and by setting the heat transfer plate 80 to be inclined downward from the switching element 60 toward the water receiving part 14. Malfunction of the control board 70 due to condensation water can be suppressed thereby.

Embodiments may include the following configurations.

(Configuration 1)

A sanitary washing device, comprising:

a nozzle discharging wash water for a private part wash;

a heat exchanger using alternating current power to heat the wash water supplied to the nozzle;

a cold water flow channel supplying the wash water to the heat exchanger from a water supply source;

a switching element switching a supply state of the alternating current power to the heat exchanger;

a control board to which a controller is mounted, the controller being operated by direct current power, the controller controlling the switching element;

a heat transfer plate configured to dissipate heat of the switching element; and a casing storing the nozzle, the heat exchanger, the cold water flow channel, the switching element, the control board, and the heat transfer plate, the switching element being mounted to the control board, the cold water flow channel including a cooling part, the cooling part water-cooling the heat transfer plate.

(Configuration 2)

The device according to configuration 1, wherein the heat exchanger is an instantaneous heat exchanger, and a distance between the heat exchanger and the switching element is greater than a distance between the cooling part and the switching element.

(Configuration 3)

The device according to configuration 1 or 2, wherein the casing includes a substrate storage part configured to store the control board in an upright state, the substrate storage part is located at a back part of the casing; and the switching element is mounted to a lower part of the control board.

(Configuration 4)

The device according to any one of configurations 1 to 3, further comprising:

a valve unit located in the cold water flow channel, the heat transfer plate being located at a position at which the heat transfer plate overlaps the valve unit in a longitudinal direction, the switching element being located at a position at which the switching element overlaps the heat transfer plate in the longitudinal direction.

(Configuration 5)

The device according to any one of configurations 1 to 4, wherein the casing includes a water receiving part, at least a portion of the water receiving part being positioned below the heat transfer plate, the water receiving part being configured to receive condensation water generated at the heat transfer plate, the heat transfer plate being inclined downward from the switching element toward the water receiving part.

(Configuration 6)

The device according to any one of configurations 1 to 5, further comprising:

a toilet lid; and a toilet lid opening/closing part configured to open and close the toilet lid, the control board being located at one side of the casing in a lateral direction, the toilet lid opening/closing part being located at an other side of the casing in the lateral direction.

Thus, according to embodiments, a sanitary washing device is provided in which the casing can be made smaller, and the effects of the heat from the switching element on the controller can be suppressed even when the switching element and the controller are mounted to one control board.

The invention has been described with reference to the embodiments. However, the invention is not limited to these embodiments. Any design changes in the above embodiments suitably made by those skilled in the art are also encompassed within the scope of the invention as long as they fall within the spirit of the invention. For example, the shape, the size the material, the disposition and the arrangement or the like of the components included in the sanitary washing device are not limited to illustrations and can be changed appropriately.

The components included in the embodiments described above can be combined to the extent possible, and these combinations are also encompassed within the scope of the invention as long as they include the features of the invention.

What is claimed is:

1. A sanitary washing device, comprising:

a nozzle discharging wash water for a private part wash;

a heat exchanger using alternating current power to heat the wash water supplied to the nozzle;

a cold water flow channel supplying the wash water to the heat exchanger from a water supply source;

a switching element switching a supply state of the alternating current power to the heat exchanger;

a control board to which a controller is mounted, the controller being operated by direct current power, the controller controlling the switching element;

a heat transfer plate configured to dissipate heat of the switching element;

a casing storing the nozzle, the heat exchanger, the cold water flow channel, the switching element, the control board, and the heat transfer plate; and a valve unit located in the cold water flow channel, the switching element being mounted to the control board, the cold water flow channel including a cooling part, the cooling part water-cooling the heat transfer plate, the casing including a substrate storage part configured to store the control board in an upright state, the substrate storage part being located at a back part of the casing, the switching element being mounted to a lower part of the control board, the heat transfer plate being located at a position at which the heat transfer plate overlaps the valve unit in a longitudinal direction, the switching element being located at a position at which the switching element overlaps the heat transfer plate in the longitudinal direction.

2. The device according to claim 1, wherein the heat exchanger is an instantaneous heat exchanger, and a distance between the heat exchanger and the switching element is greater than a distance between the cooling part and the switching element.

3. The device according to claim 1, wherein the casing includes a water receiving part, at least a portion of the water receiving part being positioned below the heat transfer plate, the water receiving part being configured to receive condensation water generated at the heat transfer plate, the heat transfer plate being inclined downward from the switching element toward the water receiving part.

4. The device according to claim 1, further comprising:

a toilet lid; and a toilet lid opening/closing part configured to open and close the toilet lid, the control board being located at one side of the casing in a lateral direction, the toilet lid opening/closing part being located at an other side of the casing in the lateral direction.

5. A sanitary washing device, comprising:

a nozzle discharging wash water for a private part wash;

a heat exchanger using alternating current power to heat the wash water supplied to the nozzle;

a cold water flow channel supplying the wash water to the heat exchanger from a water supply source;

a switching element switching a supply state of the alternating current power to the heat exchanger;

a control board to which a controller is mounted, the controller being operated by direct current power, the controller controlling the switching element;

a heat transfer plate configured to dissipate heat of the switching element; and a casing storing the nozzle, the heat exchanger, the cold water flow channel, the switching element, the control board, and the heat transfer plate, the switching element being mounted to the control board, the cold water flow channel including a cooling part, the cooling part water-cooling the heat transfer plate, the casing including a substrate storage part configured to store the control board in an upright state, the substrate storage part being located at a back part of the casing, the switching element being mounted to a lower part of the control board, the casing including a water receiving part, at least a portion of the water receiving part being positioned below the heat transfer plate, the water receiving part being configured to receive condensation water generated at the heat transfer plate, the heat transfer plate being inclined downward from the switching element toward the water receiving part.

* * * * *